US007131636B1

(12) United States Patent
Gurmu

(10) Patent No.: US 7,131,636 B1
(45) Date of Patent: Nov. 7, 2006

(54) STAPLE REMOVER WITH STORAGE BIN

(75) Inventor: Michael Gurmu, Oakland, CA (US)

(73) Assignee: Genet Michael, Oakland, CA (US)

( * ) Notice: Subject to any disclaimer, the term of this patent is extended or adjusted under 35 U.S.C. 154(b) by 11 days.

(21) Appl. No.: 11/268,206

(22) Filed: Nov. 5, 2005

Related U.S. Application Data

(60) Provisional application No. 60/627,632, filed on Nov. 12, 2004.

(51) Int. Cl.
*B25C 11/00* (2006.01)

(52) U.S. Cl. ..... 254/28

(58) Field of Classification Search ..... 254/28; 227/63; D8/48
See application file for complete search history.

(56) References Cited

U.S. PATENT DOCUMENTS 3,625,482 A * 12/1971 Viel, III ..... 254/28
5,090,663 A * 2/1992 Crutchfield et al. ..... 254/28
D356,720 S * 3/1995 Hochfeld et al. ..... D8/48
D438,440 S * 3/2001 Cheldin ..... D8/48

* cited by examiner

*Primary Examiner*—Lee D. Wilson

(57) ABSTRACT

A hand tool for removing and collecting used staples. The tool includes a handle hollowed out to form an interior compartment for storing removed staples. At a first end, or working end, and adjacent an entranceway of the compartment, is an outwardly extending prong for wedging under the bridge of an embedded staple. Adjacent to, and substantially coextensive with the prong is a guide member that acts to confine movement of removed staples toward the compartment entrance. The prong and guide define a pathway extending from the point of staple engagement at the working end of the tool, all the way to the entranceway of the storage compartment. The hand tool is designed to be separated to provide access to the interior, and includes a removable plug to dump collected staples as necessary. This hand tool avoids injuries and damage typically caused by prior staple removal devices.

10 Claims, 1 Drawing Sheet

STAPLE REMOVER WITH STORAGE BIN

CROSS REFERENCE TO RELATED APPLICATIONS

This application is entitled to the benefit of provisional patent application Ser. No. 60/627,632 filed Nov. 12, 2004; such benefit is hereby claimed under 35 USC 119(e).

STATEMENT REGARDING FEDERALLY SPONSORED RESEARCH OR DEVELOPMENT

Not applicable.

REFERENCE TO SEQUENCE LISTING

Not applicable

REFERENCE TO "MICROFICHE APPENDIX"

Not applicable

BACKGROUND OF THE INVENTION

This invention relates to the field of hand tools, and more specifically to implements for manually removing staples from stapled materials or documents.

During the early 20$^{th}$ Century, papers, fabrics and other laminar materials or documents were fastened together by sharply pointed pins, very much like "straight pins" currently used by tailors. The document pins generally were elongated, with one end bent to form a blunt pushing surface. When pinning papers or other materials, a user would employ the finger or thumb of one hand to press against the blunt pushing surface, while using finger tips of the other hand to guide the sharply pointed end of the pin in a double pass through the layers to be attached. Injuries from this procedure were common, and often to the extent that blood spots would appear on important documents.

Years later, mechanical staplers were developed, thus putting an end to the hazardous pinning method. Table model staplers were popular for decades, soon to be joined by smaller hand-wielded versions. More recently, stapling is most often performed automatically by auxiliary stapling units mounted on high volume copiers. Despite advances in stapling techniques, staple-related injuries have continued. Such injuries are no longer brought about in the stapling process, but rather occur during subsequent un-stapling.

The removal of staples from documents and other materials was often performed by hand, in the early years by force of tough thumbnails and by the sharp pointed blades of a pocketknives or letter openers. Naturally, these-techniques-induced injuries, as well. In the past quarter century or longer, special staple pullers were developed. These generally were of a hand tool variety, with a wedging blade to lift the staple.

Blade type staple removers are constructed simply by machining and angling a piece of metal into a blade or prong tip such that it can fit between the embedded legs of a staple where it is binding documents or materials. The staple is removed by grasping the device and sliding the sharp tip of the blade underneath the staple and rocking it out or simply pushing the blade further and further between the embedded legs until a thick portion of the blade displaces the staple from its binding position.

The force of the tool acts to pull on the staple at the front side of the documents, forcing the folded ends of the staple at the backside of the documents to unbend and exit from staple holes which were generated in the initial stapling process. The removed staple may fall to the desktop or floor, it may cling to the tool, or perhaps even take flight.

Other staple removers in wide use are best described as jaw-type extractors, wherein hinged jaws with curved claw-like implements are forced under a staple. As the extractor jaws are brought together by manual force, the implements cooperate to lift the staple and then push it from its clamping position. Again, the removed staples will fall, cling to the jaws or take flight.

Regardless of the tools and techniques used, a problem still exists since post-removal handling of the staple continues to cause injury. The staples, considerably deformed yet still with hazardously sharpened ends, must be plucked by hand from their new location—bound to the tool itself, scattered on the desktop, or lurking in the carpet (threatening damage to vacuum cleaners or stockings) or on the clothing of the user (threatening skin injuries and damaged clothing). Thus, a century or more of stapling technology has done little to eradicate these annoying office injuries. The broken, jammed or clinging staple can cause painful damage to the user's fingers and damage to the device itself, as well as to the documents or materials to which the staple is attached.

The prior art is filled with proposed solutions to stapling problems, but none has successfully addressed the two main issues, namely the device's effectiveness with respect to the removal and/or collection of staples, and the safety of the user performing these processes. For example, the staple remover described by Crutchfield in U.S. Pat. No. 5,090,663 suggests a blade type staple remover that provides a staple storage magazine. The magazine is in fact a gap between upper and lower prongs where removed staples are accumulated as they are removed. In this position, the user is exposed to the staples. And to remove the staples, the user must grasp the deformed staples between thumb and index finger and forcefully pull them from their wedged position in the magazine. Viel, in U.S. Pat. No. 3,625,482, discusses another blade type staple remover where staple collection is addressed. However, the removed staples pulled from the bound papers by a removal bar, must follow an uncontrolled pathway to the collection chamber, face high potential for being dropped or jamming the chamber entrance.

Thus, because of design flaws the currently available blade-type staple removers fall short of successfully addressing staple collection challenges. The object of the present invention is to solve current problems in removed staple collection, particularly where blade-type removers are employed. A further object is to provide a staple remover that successfully removes staples without allowing them to cling to, or become jammed in, the papers or the staple remover itself.

Still another object of the present invention is to provide a guard or shield to prevent staples from being projected or propelled throughout the work area, littering the workplace and endangering users. The guard or shield actually controls the movement of removed staples along a confined pathway to storage. Another object is to provide a staple remover that removes staples and stores them within the body of the remover until the storage area is emptied. Yet another object is to provide a staple remover that can be readily opened into two halves in order to grant access to the inside of the device.

A further object of the present invention is to provide a staple remover which is inexpensive, easy to use, and readily manufactured from metal, wood, plastic, or a combination of two or more of these materials. Other objects, features, and characteristics of the present invention will become apparent upon consideration of the following full description and the appended claims, with reference to the accompanying drawings, wherein like reference numerals designate corresponding elements in the various figures.

BRIEF SUMMARY OF THE SEVERAL VIEWS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention

DETAILED DESCRIPTION OF THE INVENTION

Figure 1:
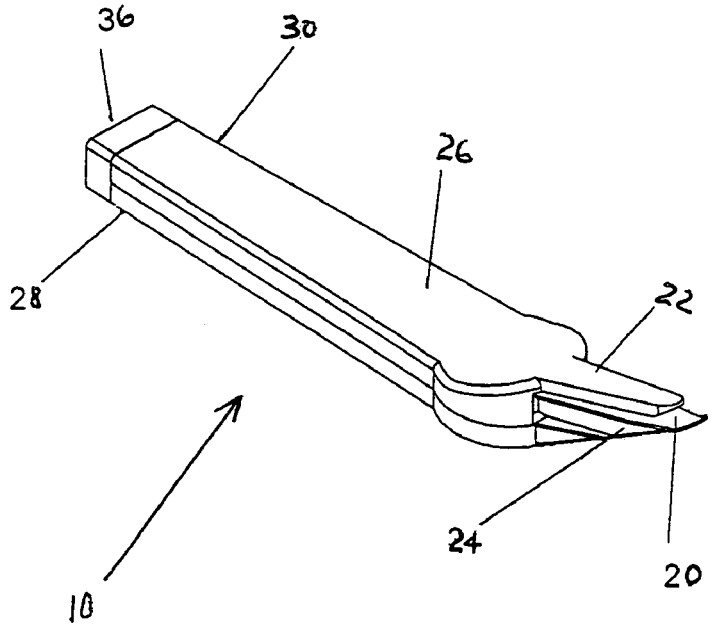
FIG. 1 is a front perspective view of the present invention, illustrating a working end of the improved staple remover projected toward the front.
Figure 2:
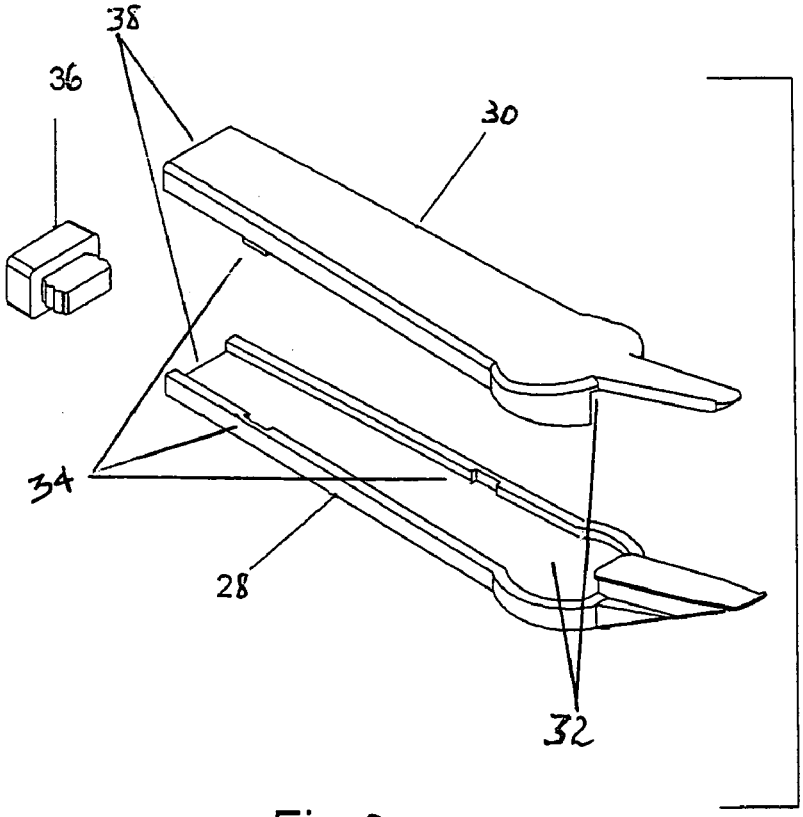
FIG. 2 is another front perspective of the present invention illustrated as an exploded view wherein two body sections are demonstrated.

A detailed description of the invent hand tool device is provided herein. It is to be understood, however, that the present invention may be embodied in various forms. Referring to the drawings in detail, FIGS. 1 and 2 show the present invention as an elongated staple remover 10 with a handle (or intermediate gripping) portion 30. Handle portion 30 further includes an upper body section 26 and lower body section 28. Said handle portion 30 serves a dual role. First, handle portion 30 is adapted to be utilized for manually wielding staple remover 10 to engage a working portion thereof to an embedded staple to be removed. Second, handle portion 30 is adapted to serve as a temporary storage container, also to be described.

As readily seen in FIG. 2, upper body section 26 may be separated from lower body section 28, and both sections are made to snap together by interconnection of elements 34. This is a typical "snap-fit" where tabs and slots (both designated as mating elements 34) are machined or molded such that they temporarily interlock which also could be a well known "friction fit." In fact, any of a variety of well known fastening systems can be employed to interconnect or mutually secure body sections 26, 28. These could include a mutual friction fit of edges of upper and lower body sections 26 and 28. Alternatively, screws, clips, snaps, clamps, or other well known connectors could be employed with essentially the same result. All such means of attachment are referred to henceforth as connector elements.

As is apparent from FIG. 2, the inside of the lower body section 28 of handle portion 30 is illustrated as hallowed out so as to form a bin, container, compartment or storage area 32. Though not viewable as such, upper body section 26 may also be hollowed out so as to form an expanded container or storage area 32 when coupled with lower body section 28. This compartment 32 extends substantially from a first end of the hand tool to a second end thereof.

At said first end, defined as the working end, of lower section 28 is an angled prong 20 extended, outwardly from adjacent an entranceway to said container. Prong 20 extends in a slightly upward direction relative to said lower and upper body sections 28,26, to a point of staple engagement. Angled prong 20 is mounted on angled anchor 24 which, in turn, may be fixed to or integral with lower section 28. The angled anchor 24 has a height with allows the staples to drop in the main body thereby preventing jamming. It should be noted that angled anchor is essentially wedge shaped, thinner at its outwardly (or forwardly) projecting end, and widening toward its intersection at an entranceway to storage area 32. At a first end, or working end, of upper section 26 is a guard or shield 22, similarly fixed to or integral with upper section 26. Guard or shield member 22 also projects outwardly or forwardly from an entranceway to storage area 32, and is slightly spaced from (and above, as viewed) said prong 20 and the guard or shield member 22 intersects the lower section 28. At an end of handle portion 30 opposite its working end is located an outlet 38 to which is affixed a removable plug 36, the purpose of which will be evident from the following discussion.

Guard/shield member 22 extends from said entranceway substantially to said point of staple engagement, Angled prong 20 is shaped and adapted to be slid under an embedded staple (affixed to papers or other materials) so as to fit between the staple and the paper or other materials. While prong 20 slips beneath the staple (for example, under the bridge that separates the pair of staple legs), the substantially coextensive guard or shield 22 slides over the staple bridge substantially at the working end of the hand tool (or staple remover) 10. As the user manually wields handle portion 30 the prong 20 is slid beneath the staple bridge and the prong 20 and anchor 24 are rocked upwardly.

In this manner, the staple (typically a short piece of wire with pointed ends puncturing the papers or materials and bent against a backside thereof) is deformed from a previously bent configuration so as to be readily extracted from puncture holes (in the papers or materials) to a front side of the papers or materials. When the retrieved staple arrives at the front side of the papers or materials (i.e., with the legs withdrawn), the bridge thereof temporarily rides freely on angled prong 20, confined thereon by guard or shield 22 as it gravitates to an inner edge of prong 20, falling into storage area 32.

Additional staples removed or retrieved as discussed above continue to slide under confined guidance of guard or shield 22 along angled prong 20 and are accumulated in temporary storage area 32. At any desired time, the user may simply remove plug 36 and dump the accumulated staples from outlet 38 and into a refuse can.

It should be evident that the inventive device described herein may be formed, molded or constructed as a unitary housing (rather than having separable upper and lower portions 26, 28). Prong 20, anchor 24 and guard/shield 22 may be integral with said unitary housing. The housing itself need not be elongated, but rather may be generally square, generally cylindrical, or other convenient shape (NOT SHOWN) with outwardly projecting prong 20, anchor 24, and guard/shield 22. Moreover, it should be apparent that more than one set of prong/anchor/guard elements (ALSO NOT SHOWN) may be included on a single storage housing/handle. For example, it may be desired to have sets of prong/anchor/guard elements that are of different size and strength so as to be applied to different size or gauge of staples (standard paper staples, heavy-duty box staples, and so on). These alternatives clearly do not depart from the scope or intent of the present disclosure nor the appended claims.

Finally, it should be evident that the inventive device disclosed herein may be fabricated or formed in a variety of ways and from a variety of materials. It may be machined and formed from metal, carved from wood, or molded from plastic, or be manufactured from a combination of materials and processes. The choice of materials and construction are clearly within the scope of the appended claims.

From the present disclosure, it will be seen that this invention provides a useful device that will help manage the removal of staples in a simple, safe, and cost-effective manner. The invention protects the user by eliminating direct contact with the sharp ends of the staple legs, protects documents and other materials being bound by the staple during the removal process, reduces the littering of the work space, and avoids vacuum cleaner mishaps and clothing damage by containing staples after removal.

Upon careful reading of the foregoing specification and reviewing the accompanying drawings it will be evident that this invention is susceptible of modifications, combinations, and alterations in a number of ways which may differ from those set forth. Accordingly, the following claims are intended to cover all such alterations and modifications which do not depart from the spirit and scope of the invention.

I claim:

1. A staple remover having a main handle portion with a staple removing prong at one end thereof, wherein said handle portion further includes an interior storage compartment for removed staples, the improvement comprising:

said interior storage compartment being inside said main handle including an entranceway;

said prong is upwardly inclined from said handle adjacent said entranceway and outwardly extending therefrom to a point of staple engagement; handle protions includes upper and lower sections;

a guard member adjacent and above said prong, and from said upper section outwardly and inwardly forming said entranceway which intersects with said lower section at a point beyond an anchor member substantially to said point of staple engagement;

said prong and said guard member cooperating to define a confined pathway for removed staples;

whereby staples removed by said upwardly inclined prong are confined by said guard member within the defined pathway as they are directed to the entranceway of said storage compartment and are restrained from moving freely from said prong wherein the prong includes the anchor member with a height for allowing the staple to have a distance between said prong and the lower section which prevents jamming.

2. The staple remover of claim 1, further defined by:

said handle portion;

connector elements binding said upper and lower section together;

at least one of said upper and lower section is hollowed out to form said storage compartment;

whereby said handle portion may be opened up to provide access to said compartment.

3. The staple remover of claim 1, further defined by:

said anchor member having a wedge shape and said anchor member extending outwardly from said storage housing;

said prong member mounted on said anchor member.

4. The staple remover of claim 2, further defined by:

said upper section of said handle portion integrally including said guard member adjacent and above said prong.

5. The staple remover of claim 2, further defined by:

both said upper and lower sections of said handle portion being hollowed out to form said storage compartment.

6. The staple remover of claim 1, further defined by:

said storage compartment closed at an end thereof by a removable plug.

7. The staple remover of claim 2, further defined by:

said connector elements including interlocking tabs and slots.

8. A hand tool for both removing and collecting used staples from their location on stapled documents and, said hand tool including:

a handle portion having a first working end and a second end for dumping collected staples, said first an second end separated by an intermediate gripping portion;

said handle portion including an interior storage compartment for temporary storage of removed used staples, said compartment extending substantially from said first end to said second end;

a removed staple confining guard member extending outwardly from said compartment adjacent said working end of said handle portion;

a staple removing prong extending outwardly from said compartment adjacent said working end to form said working end of said handle portion;

said guard member and said prong substantially coextending outwardly to said working end and defining therebetween a confined pathway for staples removed by said prong; wherein said pathway intersects with a lower section of the handle at a point beyond an anchor member which is positioned below said prong;

said confined pathway leading substantially from said working end to said interior storage compartment;

whereby staples removed by said prong are restrained from moving freely from said prong and are confined by said guard member within the defined pathway as they are directed to said storage compartment.

9. The hand tool of claim 8, further defined as:

a removable plug located at said second end for temporarily blocking said second end.

10. The hand tool of claim 8, further defined as:

said handle portion further includes an upper;

connector elements binding said upper and lower section together;

at least one of said upper and lower section is hollowed out to form said storage compartment;

whereby said handle portion may be separated for access to the interior thereof.

* * * * *